US008910492B2

(12) United States Patent
Ikeda et al.

(10) Patent No.: US 8,910,492 B2
(45) Date of Patent: Dec. 16, 2014

(54) WALL-MOUNTED AIR-CONDITIONING APPARATUS

(75) Inventors: Takashi Ikeda, Chiyoda-ku (JP); Tetsuo Yamashita, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 297 days.

(21) Appl. No.: 13/382,402

(22) PCT Filed: Dec. 24, 2009

(86) PCT No.: PCT/JP2009/071442

§ 371 (c)(1),
(2), (4) Date: Jan. 5, 2012

(87) PCT Pub. No.: WO2011/016152

PCT Pub. Date: Feb. 10, 2011

(65) Prior Publication Data

US 2012/0111045 A1 May 10, 2012

(30) Foreign Application Priority Data

Aug. 5, 2009 (JP) ..... 2009-182292

(51) Int. Cl.

| | |
|---|---|
| ***F25D 23/12*** | (2006.01) |
| ***F24F 1/00*** | (2011.01) |
| ***F04D 29/42*** | (2006.01) |
| ***F04D 17/04*** | (2006.01) |
| *F24F 13/24* | (2006.01) |

(52) U.S. Cl.

CPC ..... *F24F 1/0007* (2013.01); *F24F 2001/0048* (2013.01); *F24F 13/24* (2013.01); *F04D 29/4206* (2013.01); *F24F 1/0025* (2013.01); *F04D 17/04* (2013.01)

USPC ..... 62/263

(58) Field of Classification Search

USPC ..... 62/262, 263, 402; 415/177, 182.1; 454/201

See application file for complete search history.

(56) References Cited

U.S. PATENT DOCUMENTS

| | | | | |
|---|---|---|---|---|
| 6,086,324 | A * | 7/2000 | Ikeda et al. | 415/53.1 |
| 6,692,223 | B2 | 2/2004 | Ikeda et al. | |
| 7,603,873 | B2 * | 10/2009 | Tonin | 62/262 |

FOREIGN PATENT DOCUMENTS

| | | | |
|---|---|---|---|
| JP | 2001-059628 | A | 3/2001 |
| JP | 2003-202119 | A | 7/2003 |

(Continued)

OTHER PUBLICATIONS

International Search Report (PCT/ISA/210) issued on Apr. 6, 2010, by Japanese Patent Office as the International Searching Authority for International Application No. PCT/JP2009/71442.

(Continued)

*Primary Examiner* — Melvin Jones

(74) *Attorney, Agent, or Firm* — Buchanan Ingersoll & Rooney P.C.

(57) ABSTRACT

An upper suction port is formed in a main-body upper part of an air-conditioning apparatus main body, a suction opening part is formed in a front grill disposed on a main-body front face of the air-conditioning apparatus, a suction opening whose opening is directed upward is formed by consecutively providing an air guide wall inclined downward inside the main body on the upper edge of the suction opening, and the suction opening is located between a part, in the main-body height direction, lower than a straight line passing through a rotation center of an impeller and a closest contact point between the impeller and a front-face heat exchanger and a part, in the main-body height direction, higher than a straight line parallel with the straight line and passing through the impeller and a tongue part of a stabilizer.

4 Claims, 7 Drawing Sheets

(56) References Cited

FOREIGN PATENT DOCUMENTS

| | | | |
|---|---|---|---|
| JP | 2004-077015 | A | 3/2004 |
| JP | 2004-084996 | A | 3/2004 |
| JP | 2006-162132 | A | 6/2006 |
| JP | 2006-194459 | A | 7/2006 |
| JP | 2008-057883 | A | 3/2008 |
| JP | 2008-121968 | A | 5/2008 |

OTHER PUBLICATIONS

Office Action (Notice of Reasons for Rejection) dated Mar. 5, 2013, issued in corresponding Japanese Patent Application No. 2011-525736, and an English Translation thereof. (4 pages).

Official Action issued by Japanese Patent Office on Jun. 17, 2014 in Japanese Application No. 2013-228235, and English language translation of Official Action (5 pgs).

* cited by examiner

WALL-MOUNTED AIR-CONDITIONING APPARATUS

TECHNICAL FIELD

The present invention relates to an air-conditioning apparatus and, in particular, relates to a wall-mounted air-conditioning apparatus having heat exchangers on the front face side and the back face side of a main body, a cross flow fan mounted as blast means, an area of an opening for suction on a front grill markedly smaller than an upper suction port facing the main-body upper part, a flat-panel shape with many wall faces, and a blow-out port on a lower part on the front face.

BACKGROUND ART

One of prior-art wall-mounted air-conditioning apparatuses has a suction opening in the upper part or lower part in the main-body height direction of a portion facing the front face of a front grill in addition to a top-face suction port of a top-face panel (See PTL 1, for example).

Also, in another type of prior-art wall-mounted air-conditioning apparatus, a filter is arranged along the top-face suction port and in the vicinity of the front-face suction port, and the filter is arranged so that the distance between the filter from the top-face suction port to the suction opening of the front grill and the heat exchanger is larger than the distance between the filter and the front grill (See PTL 2, for example).

CITATION LIST

Patent Literature

PTL 1: Japanese Patent No. 3521813 (page 3, FIGS. 1 and 2)

PTL 2: Japanese Unexamined Patent Application Publication No. 2008-121968 (FIG. 1)

Non Patent Literature

SUMMARY OF INVENTION

Technical Problem

In a prior-art wall-mounted air-conditioning apparatus described in PTL 1, an area of the suction opening in the front grill is reduced, many wall faces are provided, thereby intentionally making it difficult to see the inside and thus improving the design, the suction opening in the front grill is disposed only on a part of the front grill, an air-flow guide is disposed so as to extend from the front grill to the inside of the main body, and the suction opening is formed so as to be directed upward, whereby an air amount from the front grill is made to be smaller than that of a lattice-shaped front grill of previous types, the flow traveling straight from the suction opening into the front-face heat exchanger in the shortest distance is prevented, and a uniform air flow can be formed across the entirety of front-face and back-face heat exchangers.

However, since ventilation resistance from the front grill to the cross flow fan is increased and the air amount is decreased, there are problems that a passage air amount from the back-face heat exchanger increases, and separation vortexes are generated by a difference in angle between the flow in the vicinity of the main-body upper part of the cross flow fan and the vane, which causes rotation noise and deteriorates hearing sense.

Moreover, the behavior of a circulation vortex formed in the vicinity of a tongue part inside the cross flow fan becomes unstable, and if dust in the air in a room in which the apparatus is installed is caught by the filter and accumulates, the ventilation resistance is further increased, and the behavior of the circulation v becomes further unstable.

Thus, a back-flow phenomenon in which back flow travels from the blow-out port to the cross flow fan occurs, and there is a concern that condensation occurs on the blow-out port particularly during a cooling operation, which might stain the room. In the worst case, a respiration noise as if the cross flow fan has taken a breath occurs, and noise worsens.

Also, the air-flow guide has a function of preventing the flow which travels straight from the suction opening into the front-face heat exchanger in the shortest distance but does not have a function of forcing and guiding the flow on the main-body internal side face of the front grill in the direction of a heat exchanger, and the suction flow from the upper suction port cannot be controlled, the behavior of the circulation vortex cannot be controlled, either, but becomes unstable, and there is a concern that the drop in the air amount becomes large for the change in the ventilation resistance.

Also, in another prior-art wall-mounted air-conditioning apparatus described in PTL 2, the filter is arranged along the top-face suction port and in the vicinity of the front-face suction port, and the apparatus is arranged so that the distance between the filter from the top-face suction port to the suction opening on the front grill and the heat exchanger is larger than the distance between the filter and the front grill.

Then, since the air having been sucked from the room flows to the heat exchanger after the dust has been removed by the filter, if the dust accumulates on the filter, due to the short distance between the filter from the top-face suction port to the suction opening on the front grill and the heat exchanger, the dust is removed only in the vicinity of the top-face suction port and the front-grill suction opening and not removed in the remaining regions where the distance between the front grill and the filter is short, and there is a problem that the air-amount drop caused by dust accumulation can occur in a short time, and the filter needs to be cleaned frequently.

The present invention was made to solve the above problems and an object thereof is to obtain a silent wall-mounted air-conditioning apparatus in which the behavior of the circulation vortex of the cross flow fan is stabilized, and the occurrence of the back-flow phenomenon from the blow-out port to the cross flow fan is suppressed.

Solution to Problem

A wall-mounted air-conditioning apparatus according to the present invention is, in a waft-mounted air-conditioning apparatus having an air-condoning apparatus main body, a front-face heat exchanger arranged on the main-body front face side of the air-conditioning apparatus main body, a heat exchanger arranged on the main-body back face side, a cross flow fan having an impeller disposed inside the main body of the air-conditioning apparatus main body, a stabilizer which separates the inside of the main body into an impeller suction region and an impeller blow-out region, and an arc-shaped guide wall disposed on the impeller blow-out region side and which sucks air from the impeller suction region and blows out the sucked air into the impeller blow-out region, and a front grill disposed on the main-body front face side, an upper suction port is formed in the main-body upper part of the air-conditioning apparatus, a suction opening part is formed in the front grill, a suction opening whose opening is directed upward is formed by consecutively providing an air guide wall inclined downward inside the main body on the upper edge of the suction opening, and the suction opening is located between a part, in the main-body height direction, lower than a straight line A passing through a rotation center of the impeller and the closest contact point between the impeller and the front-face heat exchanger and a part, in the main-body height direction, higher than a straight line B parallel with the straight line A and passing through the impeller and a tongue part of the stabilizer.

Advantageous Effects of Invention

In the wall-mounted air-conditioning apparatus of the present invention, since the upper suction port is formed in the main-body upper part of the air-conditioning apparatus main body, the suction opening is formed in the front grill, the suction opening whose opening is directed upward is formed by consecutively providing the air guide wall inclined downward inside the main body on the upper edge of the suction opening, and the suction opening is located between the part, in the main-body height direction, lower than the straight line A passing through the rotation center of the impeller and the closest contact point between the impeller and the front-face heat exchanger and the part, in the main-body height direction, higher than the straight line B parallel with the straight line A and passing through the impeller and the tongue part of the stabilizer, a suction space is secured inside from the suction opening, suction is facilitated and an air amount is secured, and since the flow on the air guide wall in the suction opening is closer to the circulation vortex formed in the vicinity of the tongue part of the cross flow fan, the flow can be easily supplied to the circulation vortex, whereby the behavior is stabilized, and the back-flow phenomenon from the blow-out port to the cross flow fan is difficult to occur, and thus, there is no concern that condensation on the blow-out port stains the room during the cooling operation, and a high-quality air-conditioning apparatus is obtained.

Also, since the suction opening disposed in the front grill has its opening directed upward, and the air guide wall of the suction opening is directed downward inside the main body, and the front-face heat exchanger is not seen from a user, which is good in design.

DESCRIPTION OF EMBODIMENTS

Embodiment 1

Figure 1:
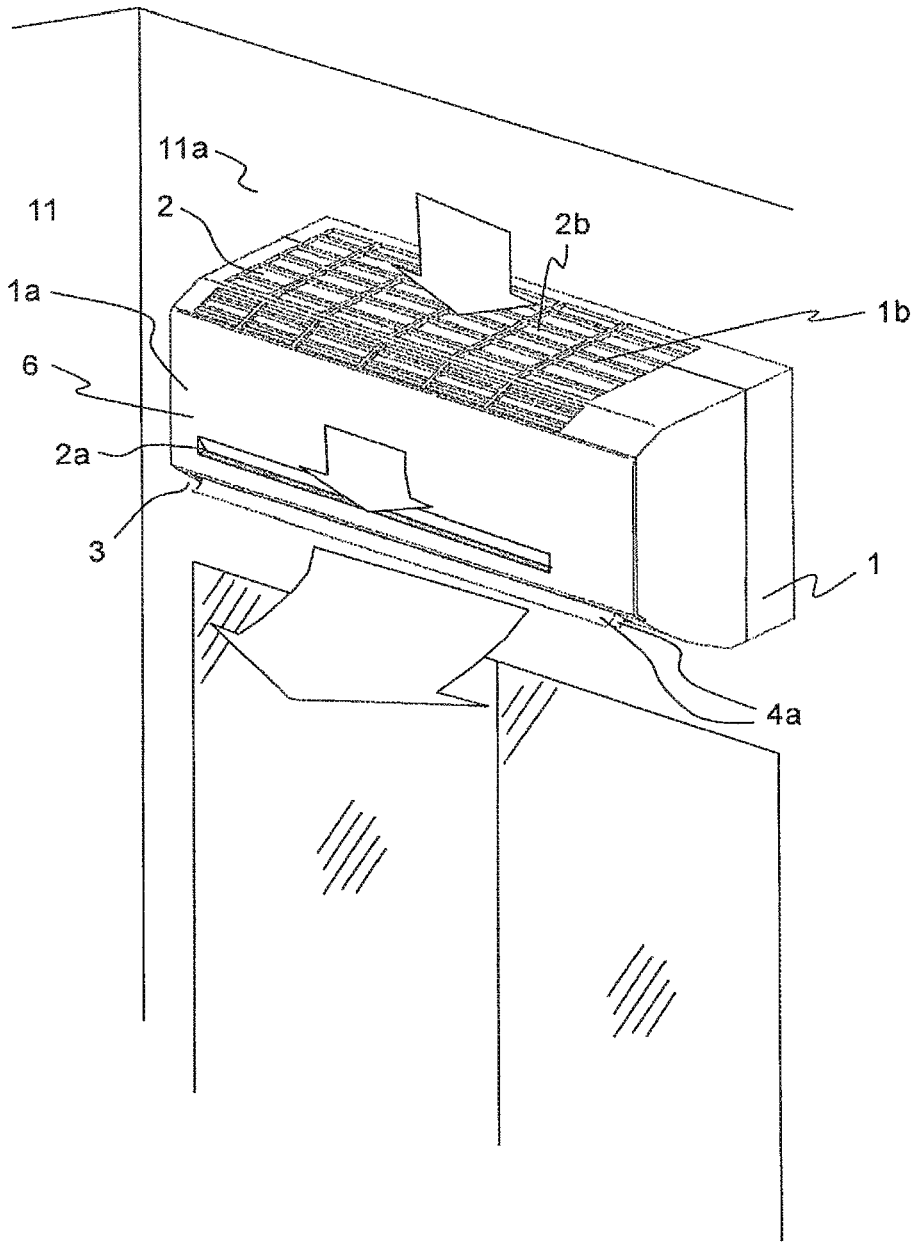
FIG. 1 is a perspective view illustrating an appearance of a wall-mounted air-conditioning apparatus of Embodiment 1 of the present invention.
Figure 2:
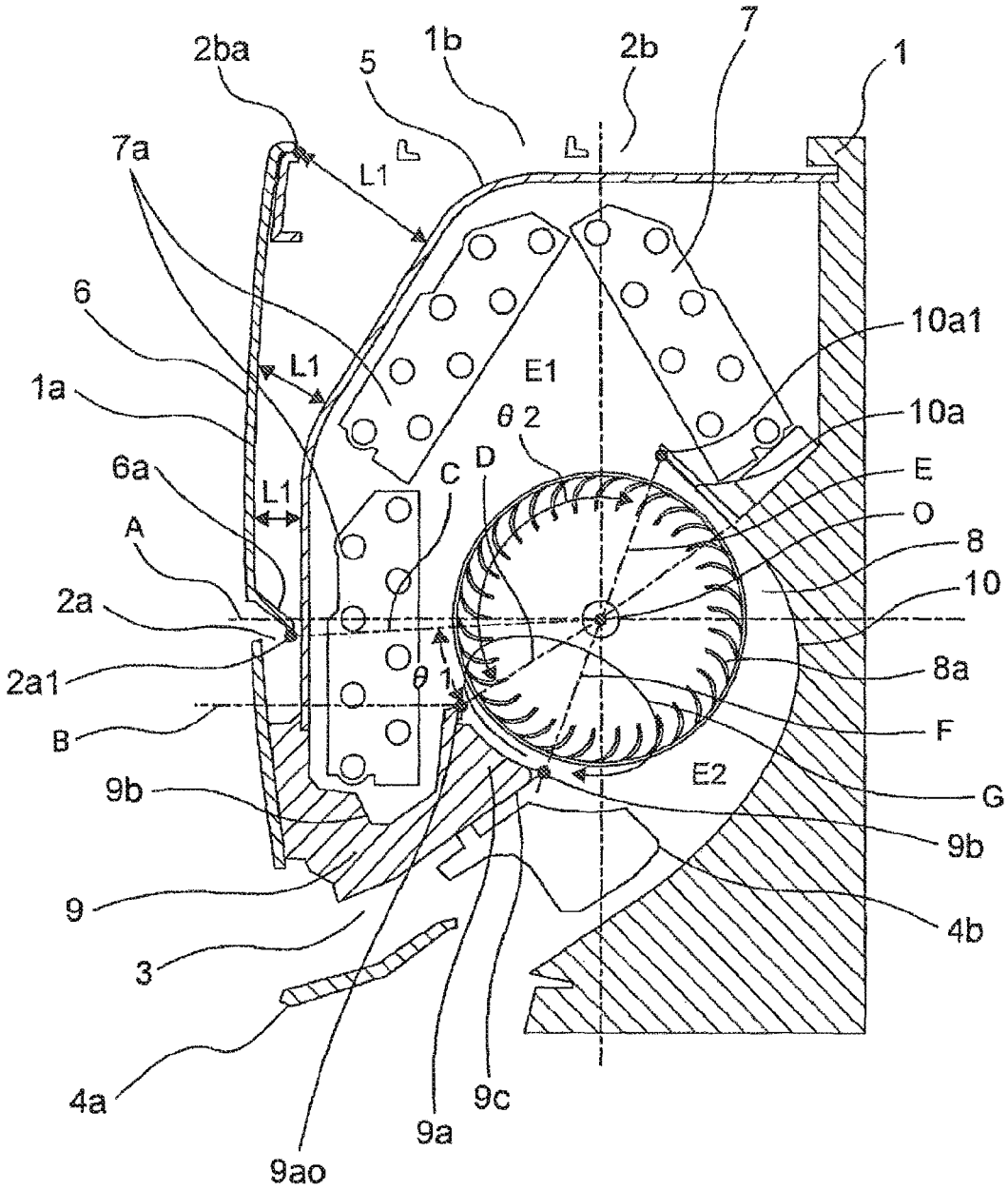
FIG. 2 is a longitudinal sectional view illustrating the air-conditioning apparatus.
Figure 3:
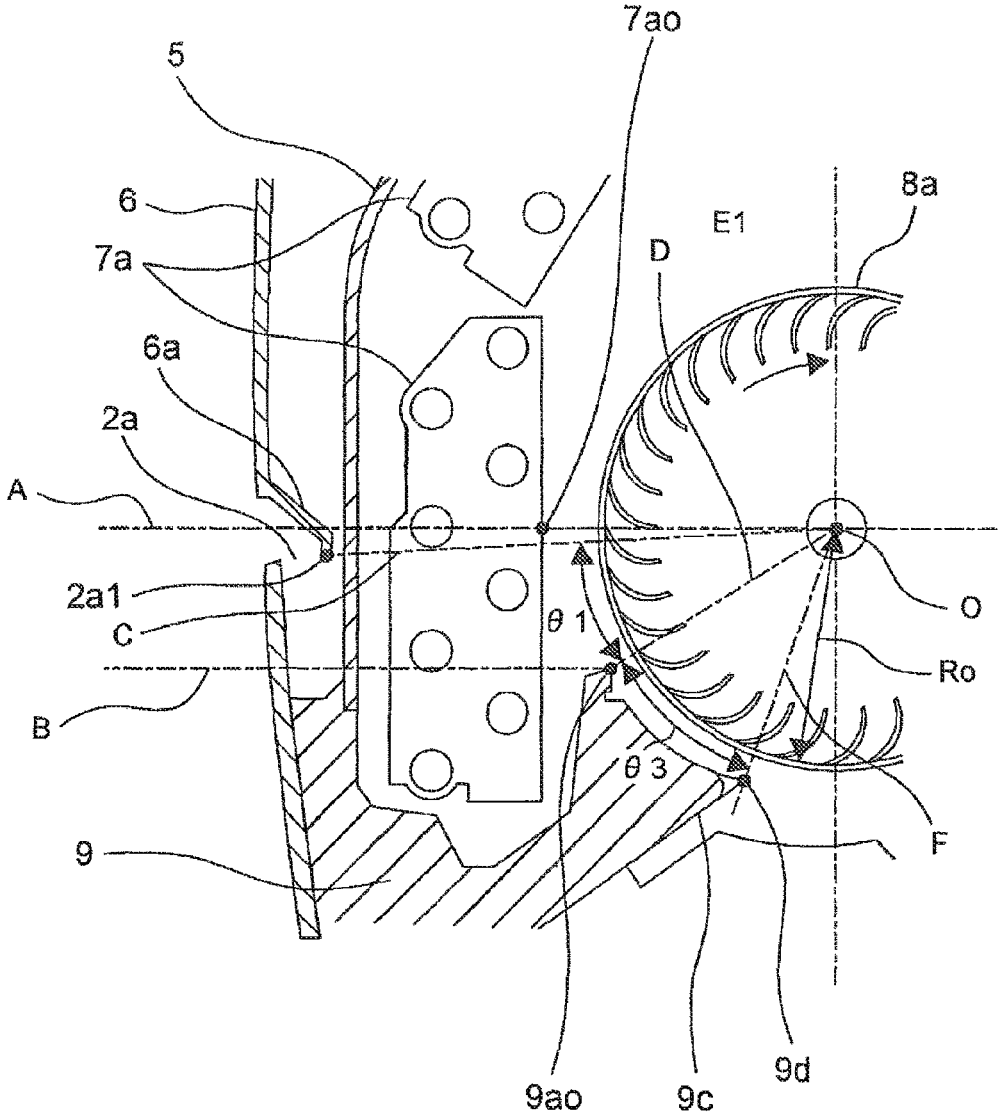
FIG. 3 is a longitudinal sectional view illustrating the vicinity of a suction opening of a front grill in the air-conditioning apparatus in an enlarged manner.
Figure 4:
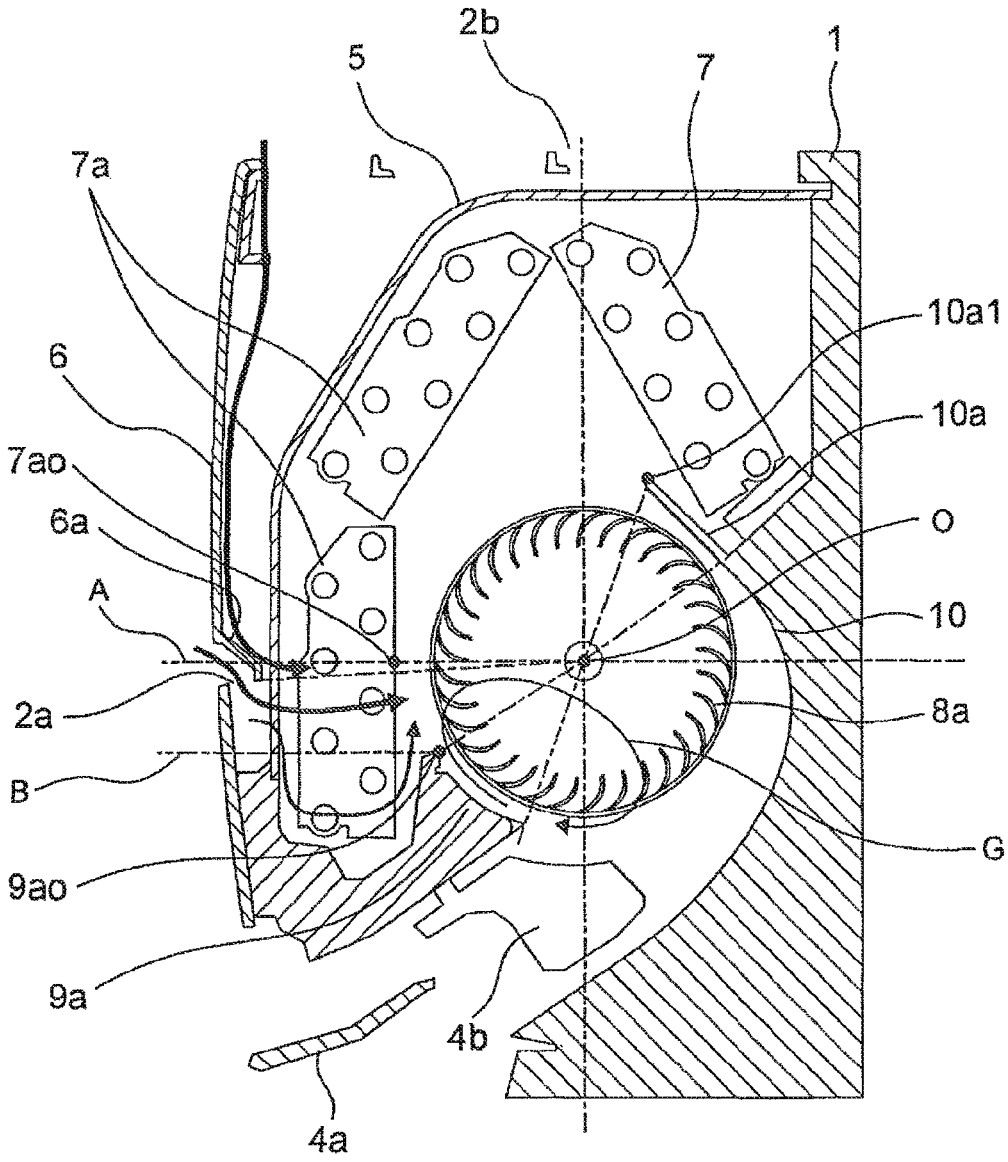
FIG. 4 is a longitudinal sectional view illustrating the flow of air sucked in the air-conditioning apparatus.

FIG. 1 is a perspective view illustrating an appearance of a wall-mounted air-conditioning apparatus of Embodiment 1 of the present invention. FIG. 2 is a longitudinal sectional view illustrating the air-conditioning apparatus, FIG. 3 is a longitudinal sectional view illustrating the vicinity of a suction opening of a front grill in the air-conditioning apparatus in an enlarged manner, and FIG. 4 is a longitudinal sectional view illustrating the flow of air sucked in the air-conditioning apparatus.

In FIG. 1, an air-conditioning apparatus main body 1 of an air-conditioning apparatus according to Embodiment 1 of the present invention is installed on a wall 11*a* of a room 11 to be air-conditioned. Also, on a main-body front face 1*a* of the air-conditioning apparatus main body 1, a removable front grill 6 is mounted, and in the front grill 6, a suction opening 2*a* is formed.

Also, in FIG. 2, in a main-body upper part 1*b* of the air-conditioning apparatus main body 1, an upper suction port 2*b*, a part of a fitter 5 which removes dust, and parts of a heat exchanger 7 and a front-face heat exchanger 7*a* which perform cooling/heating of the air are disposed. Inside the air conditioning apparatus main body 1, a cross flow fan 8, which is a fan, is disposed on the downstream side of the main-body upper part 1*b*.

The cross flow fan 8 is formed of an impeller 8*a* run by a motor, not shown, a stabilizer 9 having a tongue part 9*a* which separates an impeller suction region E1 from an impeller blow-out region E2 and a drain pan 9*b* which temporarily stores water droplets dropped from the heat exchanger 7, and an arc-shaped guide wall 10 disposed on the impeller blow-out region E2 side of the impeller 8*a*.

Moreover, at a blow-out port 3, a vertical air-direction vane 4*a* and a horizontal air-direction vane 4*b* are rotatably mounted.

Also, as illustrated in FIG. 3, the suction opening 2*a* formed in the front grill 6 is formed in the main-body height direction so as to be lower than a straight line A passing through a rotation center O of the impeller 8*a* in the cross flow fan 8 and a closest contact point 7*ao* between the impeller 8*a* and the front-face heat exchanger 7*a* and in the main-body height direction so as to be higher than a straight line B parallel with the straight line A and passing through a point 9*ao* on the tongue part, which is the closest contact point between the impeller 8*a* and the tongue part 9*a* of the stabilizer 9.

This suction opening 2*a* is formed so as to form a suction opening in the front grill 6, and an air guide wall 6*a* inclined downward inside the main body is consecutively provided on the upper edge of the suction opening with the opening directed upward. Both of the main-body side parts of the suction opening part 2*a* are formed of walls.

Then, as illustrated in FIG. 2, on the front-face heat exchanger 7*a* side of the filter 5, the closest distance L1 between the inner face of the front grill 6 and the filter 5 in the main-body height direction gradually becomes smaller from an end face 2*ba* of the front grill 6 on the upper suction port 2*b* side toward the height of the suction opening 2*a*, and the filter 5 in the vicinity of the front-face heat exchanger 7*a* is arranged so as to be substantially in parallel with the front-face heat exchanger 7*a*.

Also, as illustrated in FIGS. 2 and 3, the suction opening 2*a*, a tongue-part closest contact point 9*ao*, and a guide-wall winding-start part 10*a* are disposed so that a suction-opening-side suction region angle θ1 formed by a straight line C which connects an inner end 2*a*1 of the suction opening 2*a* of the front grill 6 to the impeller rotation center O and a straight line D which connects the closest contact point 9*ao* to the impeller 8*a* of the tongue part 9*a* to the impeller rotation center O and an impeller suction region angle θ2 formed by the straight line D and a straight line E which connects the impeller rotation center O to a winding-start end 10*a*1, which is the most upstream part of the guide wall 10, are to be a predetermined ratio.

Moreover, a tongue-part angle θ3, which is a range over which the tongue part 9*a* of the stabilizer 9 covers the impeller 8*a* of the cross flow fan 8, is an angle formed by the straight line D and a straight line F which connects a virtual intersection 9*d* with a blow-out port side face 9*c* in the tongue part 9*a* to the impeller rotation center O, and the tongue part 9*a* is formed so that the angle becomes a predetermined angle.

Subsequently, an operation of the air-conditioning apparatus in Embodiment 1 of the present invention will be described.

When electricity is supplied to the motor of the cross flow fan 8 from a power supply substrate, the impeller 8*a* of the cross flow fan 8 rotates. Then, air in the room 11 is sucked through the suction opening 2*a* of the front grill 6 on the main-body front face 1*a* and the upper suction port 2*b* of the main-body upper part 1*b*, dust in the room is removed by the filter 5 and then, the air is heated by the heat exchanger 7 for heating, cooled for cooling or dehumidified and sucked into the impeller 8*a* of the cross flow fan 8.

After that, the air blown out of the impeller 8*a* is guided by the arc-shaped guide wall 10 toward the blow-out port 3 and blown out into the room 11 for air conditioning. At this time, the direction of the blown-out air is controlled in the vertical and horizontal directions by the vertical air-direction vane 4*a* and the horizontal air-direction vane 4*b* so as to allow the air to flow across the entire room 11, and temperature variation is suppressed.

At this time, as illustrated in FIG. 4, the suction opening 2*a* opened in the front grill 6 is formed between a part, in the main-body height direction, lower than the straight line A passing through the rotation center O of the impeller 8*a* of the cross flow fan 8 and the closest contact point 7*ao* between the impeller 8*a* and the front-face heat exchanger 7*a* and a part, in the main-body height direction, higher than the straight line B parallel with the straight line A and passing through the point 9*ao* on the tongue part, which is the closest contact point between the impeller 8*a* and the tongue part 9*a* and has such a shape that the air guide wall 6*a* is inclined downward inside the main body, and thus, a part of the air flow sucked through the front-face side of the main-body upper suction port 2*b* flows downward toward the front-face heat exchanger 7*a*, where a circulation vortex G of the cross flow fan 8 with a low pressure is present, the direction thereof is changed by the air guide wall 6*a* to the inside of the fan, passes through the filter 5 and the front-face heat exchanger 7*a* and is sucked into the impeller 8*a*.

Also, since the direction of the air flow is changed to the inside of the impeller 8*a* by the air guide wall 6*a* extending to the vicinity of the filter 5 in the suction opening 2*a* formed in the front grill 6, a phenomenon in which the flow from the upper suction port 2*b* flows downward through a gap between the filter 5 and the air guide wall 6*a* does not occur, a suction space from the suction opening 2*a* cannot be secured and suctioning cannot be obtained as in the case in which the air guide wall 6*a* does not extend to the vicinity of the filter 5, but in Embodiment 1, since the suction space is secured inside from the suction opening 2*a*, suctioning is easy, and an air amount can be secured.

Moreover, if the suction opening 2*a* is formed above the straight line A and close to the upper suction port 2*b*, the direction change of the flow by the air guide wall 6*a* is performed far from the circulation vortex G formed in the vicinity of the tongue part 9*a*, and it is difficult to supply the flow to the circulation vortex G, and the behavior is not stable. Also, since the flow does not flow easily below the front-face heat exchanger 7*a*, a sufficient air amount does not flow below the front-face heat exchanger 7*a* unless the suction opening 2*a* of the front grill 6 is enlarged.

As a result, the performance of the front-face heat exchanger 7*a* deteriorates. Also, since the flow path is too large for the suction opening 2*a* and the flow becomes unstable, dust accumulates on the filter 5, the amount of increase in ventilation resistance is sufficient to cause a back flow in, the blow-out port 3 is small, and therefore the back flow occurs even with a small amount of dust.

Moreover, if the suction opening 2*a* is located below the straight line B, it becomes lower than the closest part 9*ao* with the impeller of the tongue part 9*a*, the air guide wall 6*a* also becomes at a height position equal to or lower than the closest part 9*ao* and does not control the flow, and thus, the advantage is small as in the case without the suction opening 2*a*.

Also, if the suction-opening side suction region angle θ1 is too small, the flow path from the suction opening 2*a* to the tongue part 9*a* becomes narrow, the suction air velocity to the impeller 8*a* increases, and noise deteriorates.

Thus, in Embodiment 1, since the flow can be easily supplied to the circulation vortex G formed in the vicinity of the tongue part 9*a* of the cross flow fan 8, the behavior is stabilized, and if dust in the air in the room 11 where the apparatus is installed is caught and accumulates by the filter 5, even if the ventilation resistance further increases, the behavior of the circulation vortex G is maintained stably, and the back-flow phenomenon from the blow-out port 3 to the cross flow fan 8 hardly occurs.

As a result, there is no fear that condensation on the blow-out port 3 drops and stains the room during the cooling operation and a high-quality air conditioning apparatus can be obtained.

Also, since the suction opening 2*a* is directed upward, the air guide wall 6*a* is formed on the front-face heat exchanger 7*a* side, and the front-face heat exchanger 7*a* cannot be seen by a user, which is good from a design viewpoint.

Also, in the filter 5, since the closest distance L1 between the inner face of the front grill 6 and the filter 5 in the main-body height direction gradually becomes smaller from the front-grill-side end face 2*ba* toward the height of the suction opening 2*a* on the front-face heat exchanger 7*a* side, a flow path area does not rapidly increase or decrease, an unstable vortex does not occur in the flow path, and a loss is small.

Moreover, since the filter 5 in the vicinity of the front ace heat exchanger 7*a* is disposed so as to be substantially in parallel mainly with the front-face heat exchanger 7*a*, dust in the air flow from the upper suction port 2*b* is removed, and even if dust accumulates on the filter 5, the dust does not locally accumulate in the vicinity of the upper suction port 2*b* of the filter 5 or does not rapidly increase the ventilation resistance as in the prior-art case in which the filter 5 follows the vicinity of the upper suction 2*b* but the dust accumulates uniformly in the vicinity of the air guide wall 6*a*, and thus, the drop in the air amount for the operation time is small, the increase in the power consumption of the motor which runs the impeller 8*a* is also small, and an energy-saving air conditioning apparatus can be obtained.

By setting the suction-opening-side suction region angle θ1 formed by the straight line C which connects the inner end 2*a*1 of the suction opening 2*a* of the front grill 6 to the impeller rotation center O and the straight line D which connects the closest contact point 9*ao* with the impeller 8*a* in the tongue part 9*a* of the stabilizer 9 to the impeller rotation center O to a predetermined angle, the amount of air supplied to the circulation vortex can be adjusted, and the behavior is stabilized.

However, if the suction-opening-side suction region angle θ1 is too large, the path from the suction opening 2*a* to the circulation vortex G is long, the flow path is too large for the suction opening 2*a*, and the air flow becomes unstable, and thus, even if a small amount of dust accumulates on the filter 5, back flow might easily occur in the blow-out port 3.

Also, if the suction-opening-side suction region angle θ1 is too small, the flow path from the suction opening 2*a* to the tongue part 9*a* is narrow, and an increase in the suction air velocity to the impeller 8*a* deteriorates noise.

Thus, the suction-opening-side suction region angle θ1 has an optimal range.

Figure 5:
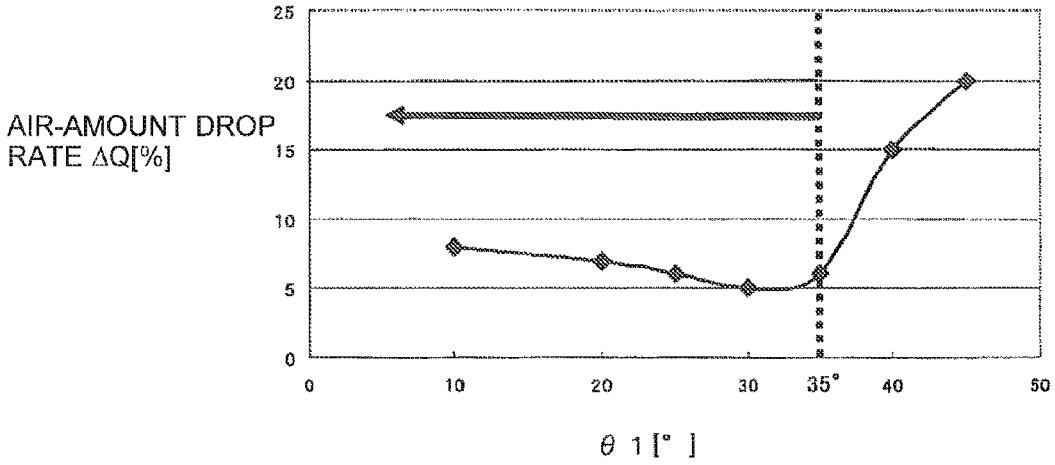
FIG. 5 is a graph illustrating a relationship between a suction-opening-side region angle θ1 and an air-amount drop rate.

The graph in FIG. 5 illustrates the relationship between the suction-opening-side suction region angle θ1 and the air-amount drop rate one month after the operation start, and as can be seen in the graph in FIG. 5, if the suction-opening-side suction region angle θ1 is not more than 35°, at least the air-amount drop rate can be kept low, and a stable operation can be realized.

Figure 6:
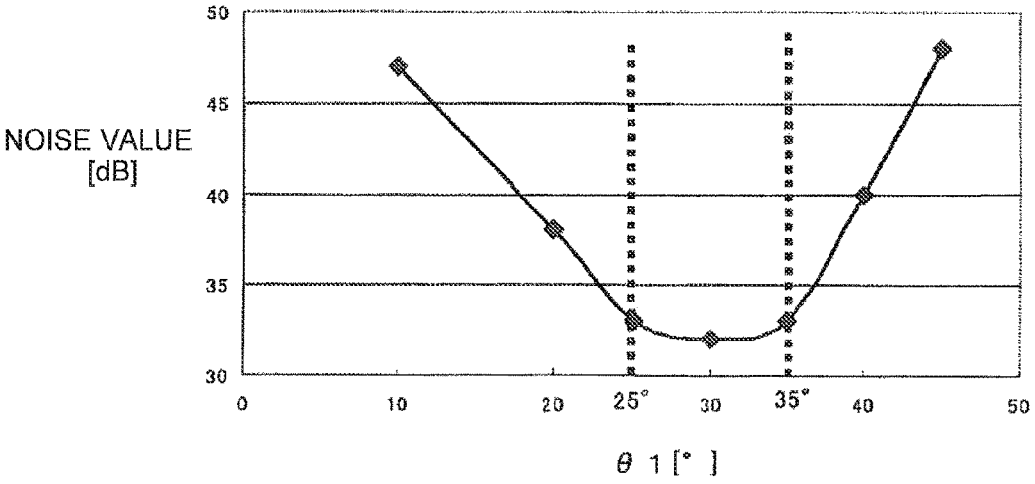
FIG. 6 is a graph illustrating a relationship between the suction-opening-side region angle θ1 and a noise value.

Also, the graph in FIG. 6 illustrates the relationship between the suction-opening-side suction region angle θ1 and the noise value when the air amount is the same, and as can be seen in the graph in FIG. 6, if the suction-opening-side suction region angle θ1 is 25 to 35°, noise is low.

As a result, if the suction-opening-side suction region angle is at least in a range of θ1=25 to 35°, the air-amount drop rate is low, and stable operation with low noise can be continued.

Also, by disposing the suction opening 2*a*, the tongue-part closest contact point 9*ao*, and the winding-start part 10*a* of the guide wall 10 so that a predetermined ratio θ1/θ2 is obtained, the suction-opening-side suction region angle θ1 and the impeller suction region angle θ2 formed by the straight line D which becomes the impeller suction region E1 of the cross flow fan 8 and the straight line F which connects the impeller rotation center O to the winding-start end 10*a*1, which is the most upstream part of the guide wall 10, the concentration vortex G is stabilized, the air-velocity distribution can be made uniform across the entire impeller suction region E1 side, and noise can be kept low.

However, if the ratio θ1/θ2 is too large, the path from the suction opening 2*a* to the circulation vortex G is too long, the flow path is too large for the suction opening 2*a*, and the flow becomes unstable, and thus, a back flow can easily occur in the blow-out port 3 even if a small amount of dust accumulates on the filter.

On the contrary, if the ratio θ1/θ2 is too small, the suction flow velocity rapidly increases in the vicinity of the tongue part 9*a* and the flow path is too large in the other suction regions, the flow becomes unstable, and noise deteriorates.

Thus, the ratio θ1/θ2 has an optimal range.

Figure 7:
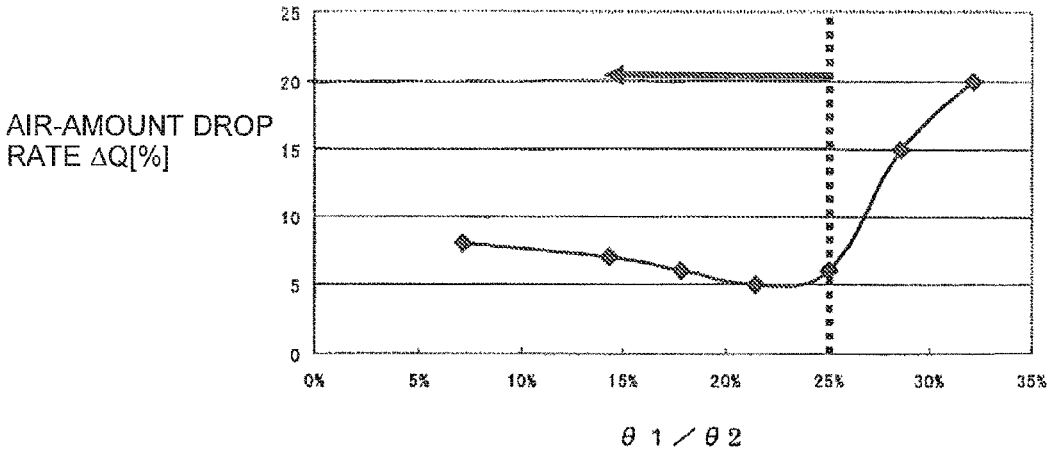
FIG. 7 is a graph illustrating a relationship between a ratio of the suction-opening-side region angle θ1 to an impeller suction region angle θ2 and the air-amount drop rate.

The graph in FIG. 7 illustrates the relationship of the air-amount drop rate one month after the operation start to the ratio θ1/θ2, and as illustrated in the graph in FIG. 7, if it is the ratio θ1/θ2=25% or less, at least the air-amount drop rate can be lowered, and a stable operation can be realized.

Figure 8:
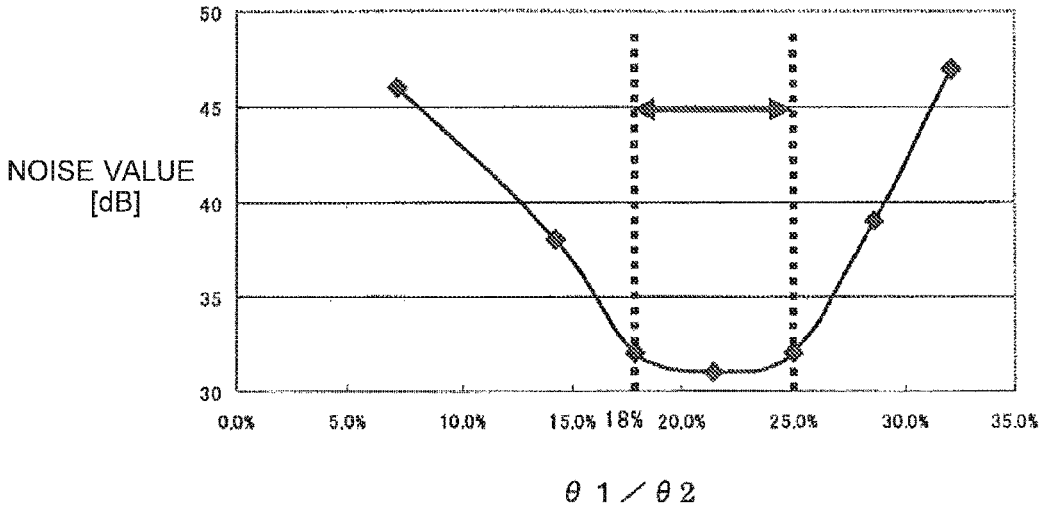
FIG. 8 is a graph illustrating a relationship between the ratio of the suction-opening-side region angle θ1 to the impeller suction region angle θ2 and the noise value.

Also, the graph in FIG. 8 illustrates the relationship of the noise value to the ratio θ1/θ2 when the air amount is the same, and as can be seen in the graph in FIG. 8, if the ratio θ1/θ2=18 to 25%, the air-amount drop rate is low and noise is also low.

Thus, if the ratio θ1/θ2=18 to 25%, the air-amount drop rate is low and the noise is low.

Moreover, with regard to the tongue-part region angle θ3, which is a range over which the tongue part 9*a* of the stabilizer 9 covers the impeller 8*a* of the cross flow fan, by forming the tongue part 9*a* so that an angle formed by the straight line D and the straight line F which connects the virtual intersection 9*c* with the blow-out port side face 9*b* in the tongue part 9*a* to the impeller rotation center O to a predetermined angle, the circulation vortex G is made stable in the vicinity of the tongue part 9*a*, and the blow-out air velocity can be reduced without decreasing the area of the impeller blow-out side region E2 by the circulation vortex G, and noise can be lowered.

However, if the tongue-part region angle θ3 is too small, an area where the circulation vortex G faces the tongue part 9*a* is reduced, and if dust accumulates on the filter 5 and ventilation resistance increases, the size of the circulation vortex G cannot be fully regulated, an air-amount drop is large and becomes unstable, and back flow can easily occur from the blow-out port 3.

On the contrary, if the tongue-part region angle θ3 is too large, the circulation vortex G is enlarged by the tongue part 9*a*, the effective air path area is reduced, passage air velocity increases, and noise deteriorates.

Thus, the tongue-part region angle θ3 has an optimal range.

Figure 9:
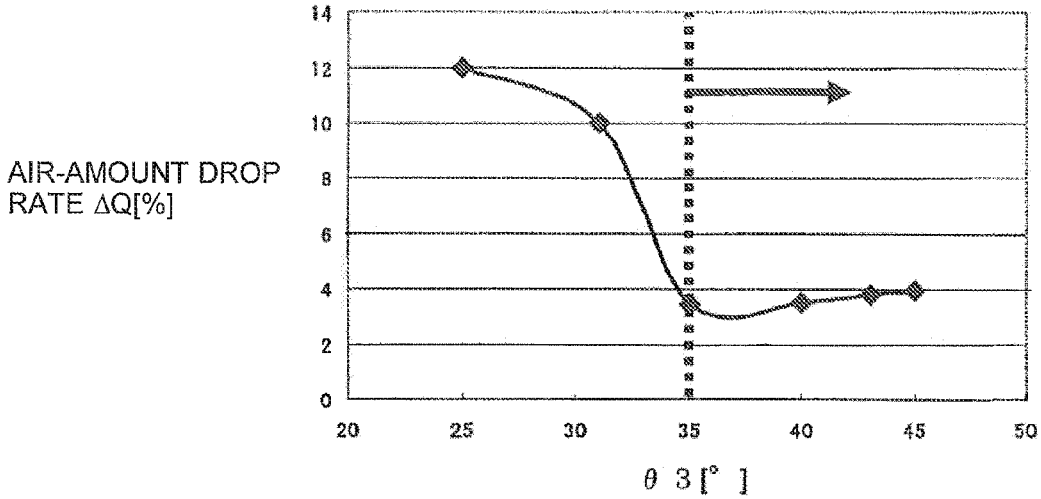
FIG. 9 is a graph illustrating a relationship between a tongue part region angle θ3 and the air-amount drop rate.
Figure 10:
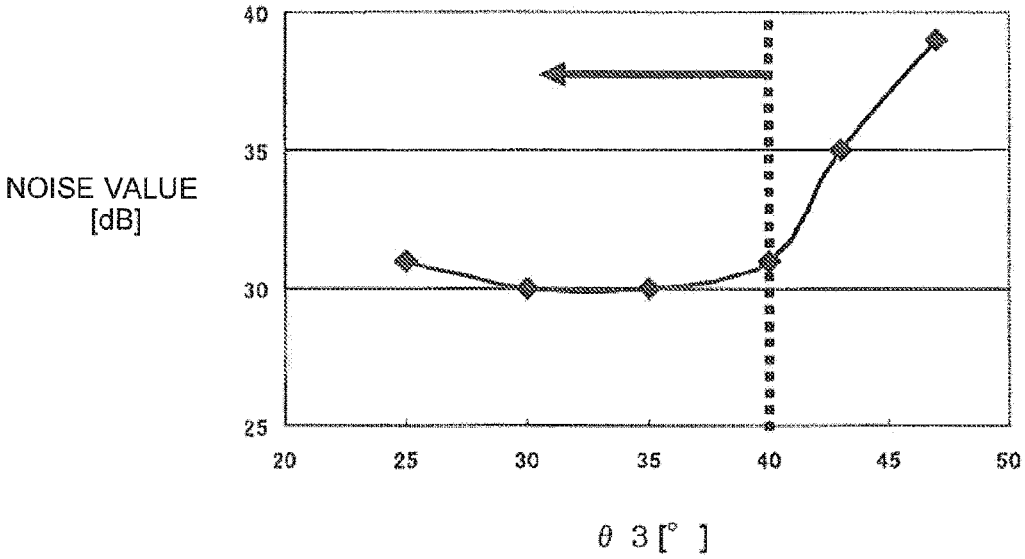
FIG. 10 is a graph illustrating a relationship between the tongue part region angle θ3 and the noise value.

The graph in FIG. 9 illustrates the relationship between the tongue-part region angle θ3 and the air-amount drop rate one month after the operation start and as can be seen in the graph in FIG. 9, if the angle θ3 is at least not less than 35°, the air-amount drop rate is small and stable. Also, the graph in FIG. 10 illustrates the relationship between the tongue-part region angle θ3 and the noise value when the air amount is the same, and if the tongue-part region angle θ3 is not more than 40°, at least noise is low.

As described above, if the tongue-part region angle θ3 is 35° to 40°, the air-amount drop rate is small and noise is low.

As described above, by regulating the position and the shape of the suction opening 2*a* to be disposed in the front grill 6 and the shape of the tongue part 9*a* of the stabilizer 9 of the cross flow fan 8, a high-quality, energy-saving and silent wall-mounted air-conditioning apparatus is obtained.

Also, by regulating the relationship of the shapes of the suction opening 2*a* to be disposed in the front grill 6 and the tongue part 9*a* to the suction air path shape of the cross flow fan 8, the behavior of the circulation vortex G of the cross flow fan 8 is stabilized, and even if dust accumulates on the filter 5, the air amount hardly lowers and a silent wall-mounted air-conditioning apparatus can be obtained.

Reference Signs List

1 air-conditioning apparatus main body, 1*a* main-body front face, 1*b* main-body upper part, 2*a* suction opening, 2*a*1 inner end of suction opening, 2*b* upper suction port, 3 blow-out port, 4*a* vertical air-direction vane, 4*b* horizontal air-direction vane, 5 filter, 6 front grill, 6*a* air guide wall, 7 heat exchanger, 7*a* front-face heat exchanger, 8 cross flow fan, 8*a* impeller, 9 stabilizer, 9*a* tongue part, 9*ao* closest contact point with impeller of tongue part, 9*b* drain pan, 9*c* blow-out port side face of stabilizer, 9*d* virtual intersection between tongue part and main-body blow-out port side face of stabilizer, 10 guide wall, 10*a* guide-wall winding-start part, 10*a*1 guide-wall winding-start end, 11 room, 11*a* wall of room, E1 impeller suction region, E2 impeller blow-out region, G circulation vortex, L1 closest distance between front-grill inner face and filter, O impeller rotation center, θ1 suction-opening-side suction region angle, θ2 impeller suction region, θ3 tongue-part region angle.

The invention claimed is:

1. A wall-mounted air-conditioning apparatus comprising:

an air-conditioning apparatus main body;

a front-face heat exchanger arranged on the main-body front-face side of the air-conditioning apparatus main body and a heat exchanger arranged on the main-body back face side;

a cross flow fan which has an impeller disposed inside the main body of the air-conditioning apparatus main body, a stabilizer which separates the inside of the main body into an impeller suction region and an impeller blow-out region, and an arc-shaped guide wall disposed on the impeller blow-out region side, sucks air from the impeller suction region and blows out the sucked air into the impeller blow-out region; and a front grill disposed on the main-body front face, wherein an upper suction port is formed in the upper part of the main body of the air-conditioning apparatus main body;

a suction opening is formed in the front grill, and a suction opening part whose opening is directed upward is formed by consecutively providing an air guide wall inclined downward inside the main body on the upper edge of the suction opening;

the suction opening part is located between a part in the main-body height direction lower than a straight line A passing through a rotation center of the impeller and the closest contact point between the impeller and the front-face heat exchanger and a part in the main-body height direction higher than a straight line B in parallel with the straight line A and passing through the impeller and a tongue part of the stabilizer; and a suction-opening-side suction region angle θ1 formed by a straight line C which connects a distal end of an air guide wall of the suction opening to the impeller rotation center O and a straight line D which connects a closest contact point with the impeller in a tongue part of the stabilizer to the impeller rotation center O is formed so as to be 25 to 35°.

2. The wall-mounted air-conditioning apparatus of claim 1, wherein a filter is disposed inside the main body of the air-conditioning apparatus main body, and the filter is arranged so that a closest distance L1 between the filter and the front grill gradually becomes smaller from an end of the front grill on the upper suction port side toward the suction opening part in the main-body height direction and follows the front-face heat exchanger substantially in parallel.

3. The wall-mounted air-conditioning apparatus of claim 1, wherein the suction opening part, the closest contact point with the impeller in the tongue part, and a most upstream end of the guide wall are disposed so that a ratio θ1/θ2 of the suction-opening-side suction region angle θ1 to an impeller suction region angle θ2 formed by the straight line D and a straight line E which connects the impeller rotation center O to the most upstream end of the guide wall becomes 18 to 25%.

4. The wall-mounted air-conditioning apparatus of claim 1, wherein a tongue-part angle θ3, which is a range over which the tongue part of the stabilizer covers the impeller, is an angle formed by the straight line D and a straight line F which connects a virtual intersection with a blow-out port side face in the tongue part to the impeller rotation center O, and the tongue part is formed so that θ3 is 35° to 40°.

* * * * *